US008075456B2

(12) United States Patent
Fugitt

(10) Patent No.: US 8,075,456 B2
(45) Date of Patent: Dec. 13, 2011

(54) SQUAT TRAINING DEVICE

(76) Inventor: Nathan B. Fugitt, Dublin, OH (US)

( * ) Notice: Subject to any disclaimer, the term of this patent is extended or adjusted under 35 U.S.C. 154(b) by 155 days.

(21) Appl. No.: 12/033,277

(22) Filed: Feb. 19, 2008

(65) Prior Publication Data

US 2008/0199839 A1 Aug. 21, 2008

Related U.S. Application Data

(60) Provisional application No. 60/890,574, filed on Feb. 19, 2007.

(51) Int. Cl.
*A63B 21/00* (2006.01)

(52) U.S. Cl. ..... 482/92; 482/75; 36/132

(58) Field of Classification Search ..... 482/75–77, 482/79–80, 91–92, 121–130, 145, 148, 907, 482/908; 434/247, 258; 623/28; 36/101, 36/114, 117.8, 117.9, 118.1, 118.5, 118.6, 36/135, 136, 132, 77 M, 142, 143, 144; 2/245, 2/912, 920; 84/422.1, 422.2, 422.3, 426
See application file for complete search history.

(56) References Cited

U.S. PATENT DOCUMENTS 757,983 A * 4/1904 Vaile ..... 36/114
2,646,282 A * 7/1953 Ringman ..... 482/51
4,178,013 A * 12/1979 Bataille ..... 280/618
4,484,740 A 11/1984 Green
4,823,426 A * 4/1989 Bragga ..... 15/210.1
4,888,875 A 12/1989 Strother
5,246,749 A * 9/1993 Handzlik ..... 428/8
5,400,529 A * 3/1995 Bell et al. ..... 36/93
5,675,915 A * 10/1997 Faughn et al. ..... 36/7.5
5,836,094 A * 11/1998 Figel ..... 36/131
5,980,351 A * 11/1999 McCook ..... 446/26
6,006,451 A * 12/1999 Morris et al. ..... 36/115
6,035,554 A * 3/2000 Duncan ..... 36/11.5
6,146,317 A * 11/2000 Prusick ..... 482/130
6,152,865 A * 11/2000 Beauvoir ..... 482/140
6,206,807 B1 * 3/2001 Cowans et al. ..... 482/79
6,257,998 B1 * 7/2001 Ein-Gal ..... 473/518
6,412,197 B1 * 7/2002 Krull ..... 36/136
6,648,803 B1 * 11/2003 Jay ..... 482/76
6,742,908 B2 * 6/2004 Bland ..... 362/84
7,108,640 B2 * 9/2006 Emmert ..... 482/75
7,152,286 B2 * 12/2006 Rooney et al. ..... 24/712.6
7,294,114 B1 * 11/2007 Clement et al. ..... 602/23
7,297,091 B2 * 11/2007 Nushart ..... 482/79
7,364,534 B2 * 4/2008 Zoller et al. ..... 482/80
7,546,695 B2 * 6/2009 Aveni et al. ..... 36/28
7,640,640 B1 * 1/2010 Watkins ..... 24/712.3
7,674,207 B1 * 3/2010 Weaver et al. ..... 482/75
7,946,965 B2 * 5/2011 Carbonero ..... 482/75
2005/0126047 A1 * 6/2005 Kruijsen ..... 36/118.5
2007/0232459 A1 * 10/2007 Lin ..... 482/75
2008/0058171 A1 * 3/2008 Sener et al. ..... 482/75

* cited by examiner

*Primary Examiner* — Loan Thanh
*Assistant Examiner* — Daniel Roland
(74) *Attorney, Agent, or Firm* — James R. Eley; Michael A. Forhan; Eley Law Firm Co. LPA

(57) ABSTRACT

A squat training device. A generally planar base is shaped to receive a shoed foot of a user. A plurality of straps are coupled to the base and are configured to secure the shoed foot to the base. A vertical member is detachably coupled to a front toe portion of the base and extends upwardly from the base to provide the user thereof with feedback regarding a predetermined exercise form.

19 Claims, 10 Drawing Sheets

SQUAT TRAINING DEVICE

This application claims priority to U.S. provisional patent application No. 60/890,574, filed Feb. 19, 2007, the contents of which are hereby incorporated by reference.

FIELD

The present invention relates generally to exercise training equipment, in particular to a device for teaching safe and proper weight lifting technique for the squat exercise.

BACKGROUND

Weight training can be very valuable to athletes to help improve their strength, athletic abilities, stamina and to decrease their risk of sustaining an injury during a game or event. Weight training can also provide many of the same benefits to the non-athlete and may be utilized to improve overall fitness and quality of life. The benefits of weight training may be achieved to a greater extent when the weight training exercises are done properly and with correct technique or form. Using proper technique reduces the risk of injury during the exercise and allows the exercise to work the desired muscles in an optimal manner.

Weight training generally refers to exercises in which a person lifts, pulls, presses or otherwise works against a form of resistance. The resistance may be in the form of free-weights, dumbbells, barbells or resistance bands or may be a system of pulleys and cables interconnected to stacked weights or bendable rods. A person's own body weight may also be used as the resistance in exercises such as push-ups or pull-ups.

Proper form in a given weight training exercise generally implies that the exercise is performed in a manner that utilizes body positions and motions that allow the weight to be lifted without harming the body while also targeting a desired muscle or muscle group. Generally, body positions associated with proper form are designed to provide the weight lifter with a strong, stable stance so as not to cause them to fall during the exercise. The body positions also provide correct orientation of body parts, such as the spine, back, arms and knees, to allow those body parts to best support the body, and the lifted weight, without incurring damage such as sprains, strains, ruptures, tendon avulsions and compartment syndrome. Further, correct positioning of the body may lead to correct movement of the body during the lifting exercise, which may in turn decrease the risk of injury to the body. Correct movement of the body during an exercise places the stresses and strains of the exercise on the muscles, joints, tendons and ligaments most capable of handling them and in a manner most conducive to their natural movements. By doing so, the risk of injury is decreased and the desired muscle or muscle groups are isolated and worked by the exercise.

In the exercise referred to as the "squat," a weight lifter lifts a weight from a squatting position to an upright position using the muscles of the legs and lower body to lift the weight. To do so they may, depending upon the form of weight being used, begin from a standing position with a dumbbell in each hand and held at their sides, arms extended, or may begin by placing a weighted barbell across their shoulders and behind their head. The weight lifter may then bend at the hips and knees to lower their body to a squatting position wherein their thighs are parallel, or just above parallel, to the ground. After a short pause the weight lifter lifts the weight back to a standing position by re-extending his legs.

Proper technique requires the weight lifter to keep their knees even with or behind their toes and to not allow their knees to flare laterally inward or outward from a position above their feet. Proper form also requires the weight lifter to keep their heels on the ground and to keep their back and spine aligned, and generally upright, during the downward and successive upward motions. By retaining such an alignment and positioning the weight lifter's weight and center of gravity remains centrally located over their feet, and thereby their own weight and the resistance weight may be supported by their body from a natural and structurally strong position. Further, in such a position the work required to lift the resistance weight is more directly concentrated on the desired muscle or muscle group, in this case, the muscles of the thighs and buttocks. Also, by following proper form the weight lifter can complete the exercise with reduced risk of injury to their spine, back or knees, among other parts of the body.

If the weight lifter strays from proper form the resistance weight and/or their center of gravity may shift, thereby increasing the strain on body parts other than their thighs and buttocks. For example, where the weight lifter allows their knees to move forward in front of their toes or laterally away from their feet, unnecessary strain is placed on the knee and may inflame, strain, tear or otherwise damage the tendons or ligaments of the knee. In addition, if the weight lifter's form causes their knees to bend beyond the point where their thighs are parallel to the ground excessive shear loading occurs on the knee in a position in which the articular cartilage is thinnest, which may result in damage to the weight lifter's knee. Further, if the weight lifter allows their heels to rise up off of the ground or if they bend too far forward their center of gravity shifts forward, thereby placing increased strain on their lower back. Allowing any of these improper movements to occur may injure or irritate the weight lifter's knees, back or spine, among other body parts and may even cause them to lose their balance and fall.

Devices have been created to assist exercisers in achieving and learning proper form and targeting specific muscles or muscle groups, such as U.S. Pat. No. 4,888,875 to Strother and U.S. Pat. No. 4,484,740 to Green. Such devices provide safety features to assist a weight lifter in discontinuing a lift when a weight becomes too heavy, or provide some system for notifying the weight lifter when their form is not correct. However, devices available in the art are bulky, complicated, difficult to use and can not be conveniently stored or transported. No known device is available to assist weight lifters in obtaining proper form in the squat exercise. There is a need for a squat training device that is easily used to obtain proper form for the squat exercise and is easily assembled, disassembled, stored and transported.

SUMMARY

A squat training device is disclosed according to the present invention. The squat training device assists a weight lifter in learning proper form for performing the squat exercise. The present invention also provides a way to ensure the use of proper weight lifting form for the squat exercise through visual, tactile and aural feedback.

An object of the present invention is a squat training device. A generally planar base is shaped to receive a shoed foot of a user. A plurality of straps are coupled to the base and are configured to secure the shoed foot to the base. A vertical member is detachably coupled to a front toe portion of the base and extends upwardly from the base to provide a user thereof with feedback regarding a predetermined exercise form.

Another object of the present invention is a method for using a squat training device. The method includes the steps of coupling a generally planar base to each of a user's feet and securing the bases to the user's feet with a plurality of straps. A vertical member is coupled to a front toe portion of each of the bases such that the vertical members extend upwardly from the base, proximate the user's knees, to provide the user with feedback regarding a predetermined exercise form.

BRIEF DESCRIPTION OF THE DRAWINGS

Further features of the inventive embodiments will become apparent to those skilled in the art to which the embodiments relate from reading the specification and claims with reference to the accompanying drawings, in which:

DETAILED DESCRIPTION

Figure 1:
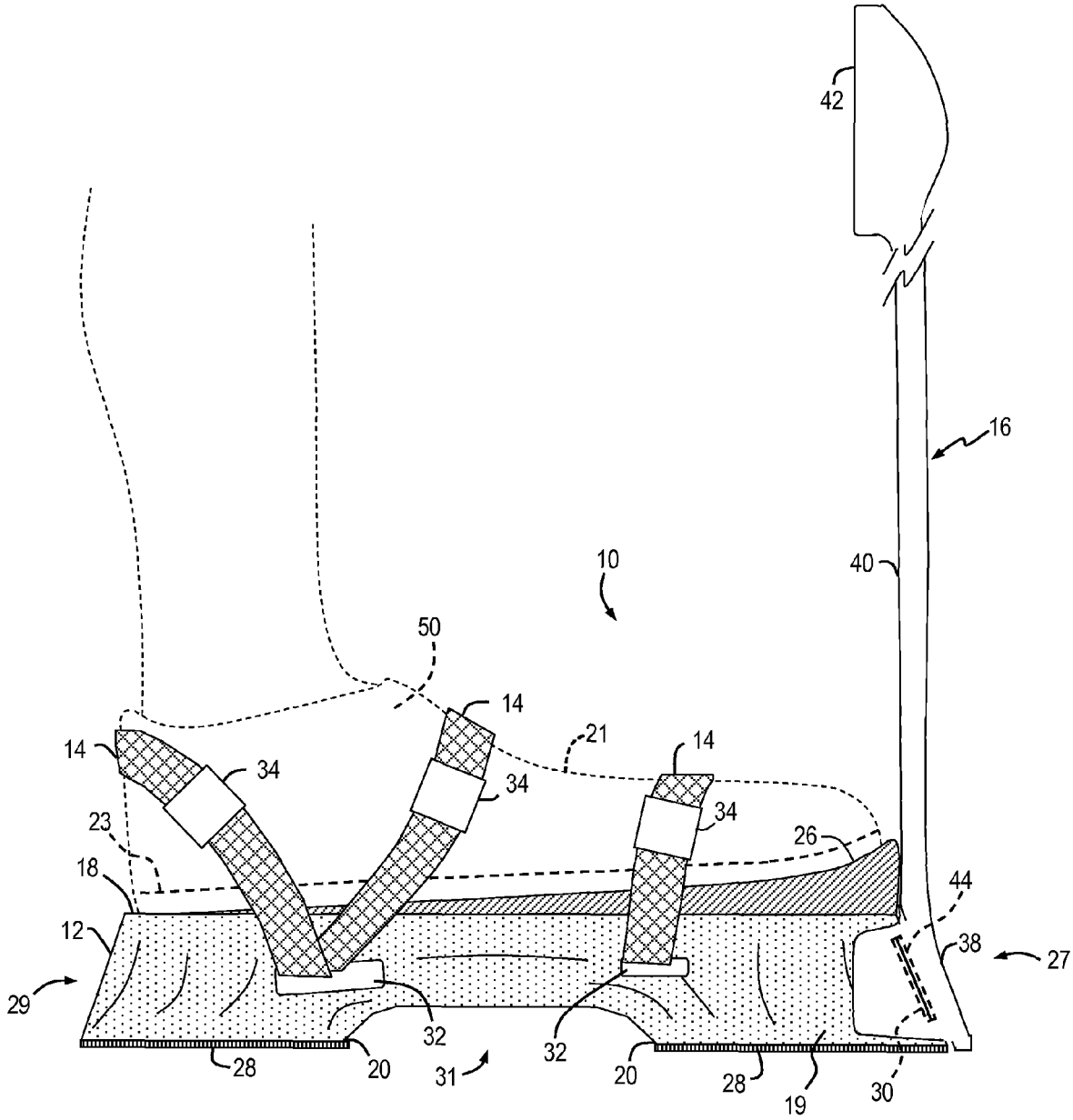
FIG. 1 is a side elevation of a squat training device according to an embodiment of the present invention.

Embodiments of the present invention are described below with reference to the figures, in which like reference numerals refer to like elements in the various views.

The general arrangement of one out of a complementary pair of squat training devices 10 is shown in FIG. 1 according to an embodiment of the present invention. Squat training device 10 comprises a base 12, a plurality of straps 14 and a vertical member 16.

Base 12 includes a top portion 18 and a spaced-apart bottom portion 20, both being generally parallel surfaces and generally approximating the shape of the sole of an athletic shoe 21 in order to receive the athletic shoe, but may be other shapes including, without limitation, rectangular or oblong. Preferably, base 12 is shaped to interchangeably receive either a left or right shoe 21. Base 12 may be of any suitable thickness. For example, in some embodiments of the present invention base 12 may be configured such that top portion 18 and bottom portion 20 are spaced apart, forming a sidewall 19 that is generally about 1 to about 2.5 inches thick. Top portion 18 is typically slightly larger than a sole 23 of an athletic shoe 21 to allow the athletic shoe to completely fit within the perimeter of the top portion of base 12. Top portion 18 may also be provided with a contour (not shown) suitable for interaction with (e.g., engaging the shape and/or tread of) the sole of an athletic shoe or may be a generally planar surface, as depicted in FIG. 1. Bottom portion 20 may be slightly larger in size than top portion 18 to provide increased stability to base 12 and to impart outwardly and downwardly sloping, flared or angled sides to the base. In some embodiments of the present invention bottom portion 20 may be about 5 to 50 percent larger than top portion 18.

Base 12 may be manufactured in varying sizes to accommodate the various shoe sizes of different users, and may be made from any non-flexible material designed to provide support for a user standing atop the base and to resist bending during use of squat training device 10. Examples of such materials include, without limitation, plastics, composite materials, wood and metal.

Figure 2:
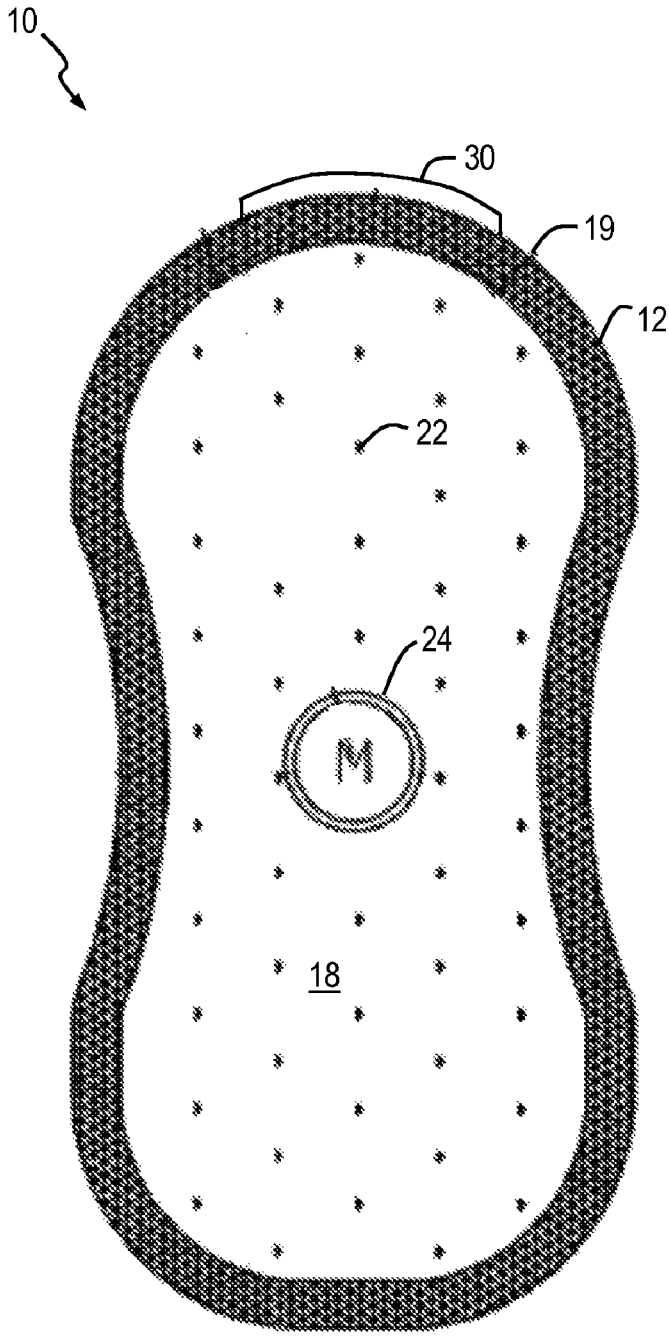
FIG. 2 is a top plan view of a top surface of a base of the squat training device of FIG. 1.

As depicted in FIG. 2, top portion 18 may include traction features 22 such as bumps, knobs, dimples, treads or other surface protuberances or depressions. Traction features 22 provide additional friction between the sole 23 of an athletic shoe 21 (FIG. 1) and base 12, and may also provide a desirable aesthetic design or appearance. Additionally, top portion 18 may include a size indicator 24 for indicating to a user the size of squat training device 10. Size indicator 24 can be any letter, number, symbol or combination thereof typically employed for such indications and is generally affixed to top portion 18 by, for example, printing, painting, molding, cutting, etching, branding, sewing or writing among others. Traction features 22 and size indicator 24 may be integral to top portion 18, being molded, cut or otherwise formed within the surface. Alternatively, traction features 22 and size indicator 24 may be formed in a separate layer of material such as rubber, plastic, felt or cotton, among others, and attached to top portion 18 in any conventional manner, such as with adhesive or fasteners.

Referring again to FIG. 1, top portion 18 is shown with a rim 26 about its perimeter to assist a user in properly centering and positioning their foot and athletic shoe 21 within squat training device 10. Rim 26 comprises an edge, lip, ridge or rim extending generally upwardly from top portion 18. Rim 26 may be molded or manufactured integral with base 12, or may comprise a separate piece of material attached to top portion 18 of the base in any conventional manner, such as with adhesive or fasteners. In some embodiments of the present invention rim 26 may typically extend upwardly about an eighth to about one-half inch from top 18 but may extend up to about an inch. Rim 26 may be included along the entire perimeter of top 18, or may extend only along portion of the perimeter. Additionally, as depicted in FIG. 1, rim 26 may extend to its full height near a front or toe area 27 of base 12 and then diminish in height toward a rear or heel end 29 of the base. Rim 26 may be configured with generally planar sides having squared-off edges, or may be curved or cupped to provide added comfort or adaptability to the sole of athletic shoe 21. Rim 26 may be constructed using the same material as base 12, or may comprise any other material compatible with the base and the expected environment for squat training device 10. Example alternate materials include, without limitation, foam or a soft plastic.

Bottom portion 20 may be formed having a flat, smooth surface or may be provided with an integral tread 28 molded, cut or otherwise formed within the surface to provide additional traction for the user during use of squat training device 10. Tread 28 may have any suitable tread pattern. Alternatively, tread 28 may be formed in a separate layer of material and attached to bottom portion 20. Where tread 28 is attached to bottom portion 20, such attachment may be made with glue, among other adhesives, or with fasteners such as tacks, or screws, among others. The tread 28 material may be the same as that selected for base 12 or may be a rubber, plastic, synthetic or other material to provide a durable friction surface for traction.

Bottom portion 20 may also contain a hollowed or cutaway section 31 along the mid-sole region between toe end 27 and heel end 29 of the base as depicted in FIG. 1. The size and shape of such a section is determinable by design based on material properties such as the weight and stiffness of base 12, and may aid in reducing the weight of squat training device 10 as well as reducing material costs for base 12, among other benefits.

Figure 5:
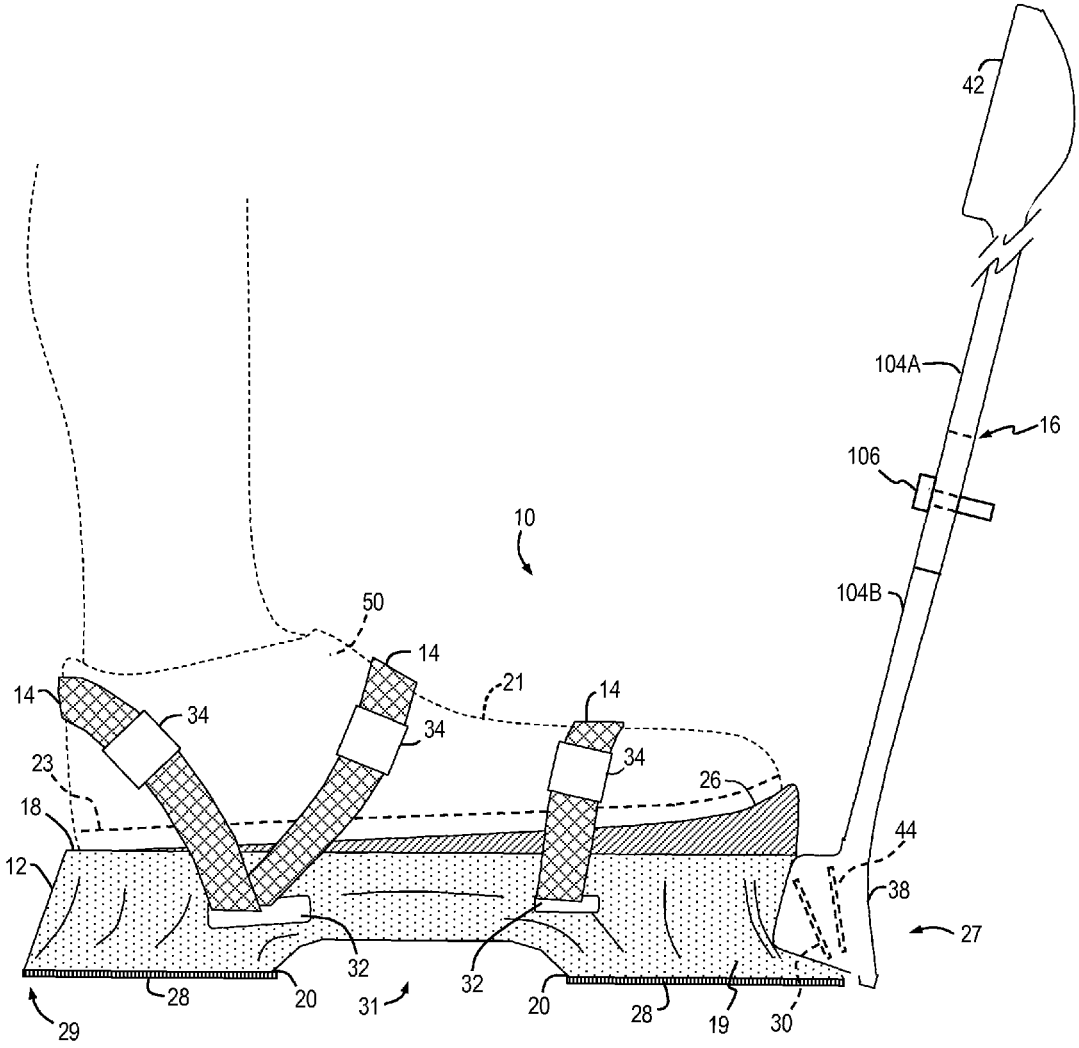
FIG. 5 is another side elevational view of the squat training device of FIG. 1, showing the vertical member being disengaged from the base.

As shown in FIG. 2, a first connector 30 is located along the sidewall 19 of base 12 proximate the toe or front end 27. First connector 30 generally comprises a fixture designed to cooperate with, and removably connect to vertical member 16 (FIG. 1). First connector 30 may be any type of fixture suitable for, and compatible with, detachably coupling to vertical member 16, such as hook-and-loop, clips, tabs, magnets and/or materials configured to attract and engage a magnet (including ferrous materials), and fasteners. The device employed for first connector 30 is preferably sufficiently robust to withstand repeated connecting and disconnecting without damage or undue wear, while also providing sufficient retention force for engaging vertical member 16. As can be seen in FIG. 1, first connector 30 also provides a breakaway connection between base 12 and vertical member 16 such that when the vertical member is contacted during use of squat training device 10 the vertical member may initially resist movement but will disconnect from the base when the contact continues to move the vertical member beyond a predetermined position, as shown in FIG. 5.

FIG. 1 also depicts a plurality of apertures 32 in base 12. Apertures 32 are hollow passages extending through sidewall 19 of base 12 that pass generally horizontally from one side of the base to an opposing side. The passages for apertures 32 are generally parallel to each other and are generally transverse to the longitudinal axis of base 12. Apertures 32 are preferably sufficiently sized to allow one or more of straps 14 to pass therethrough.

With continued reference to FIG. 1, a plurality of flexible straps 14 are coupled to base 12, passing through apertures 32 and having a length suitable for wrapping around the upper portion of base 12, including top portion 18 and a user's foot or athletic shoe 21 placed thereon. Straps 14 may utilize tabs 34 to assist a user in gripping the ends of the straps and to protect the ends of the straps from wear. Tabs 34 typically comprise a rubber, plastic or metal component that fixedly attaches to one end of strap 14. Straps 14 also include a closure or retention feature such as a clasp, buckle, or hook-and-loop, among others, to retain the strap in a desired position. Straps 14 may be attached to base 12 with glues, adhesives, stitching, screws or staples, among others, or may be left unattached. Additionally, although straps 14 are each shown as a single piece of material in FIG. 1, they may comprise two separate pieces with one attached to opposing sides of base 12, and detachably coupling together via a buckle, clasp, hook-and-loop or other similar device. Straps 14 preferably have sufficient resistance to stretching such that a foot and athletic shoe 21 is held substantially rigid against base 12 during use of squat training device 10. Any suitable material that will provide sufficient strength and durability may be utilized for straps 14, including, but not limited to, nylon, cotton, polyester, plastic and rubber.

Figure 3A:
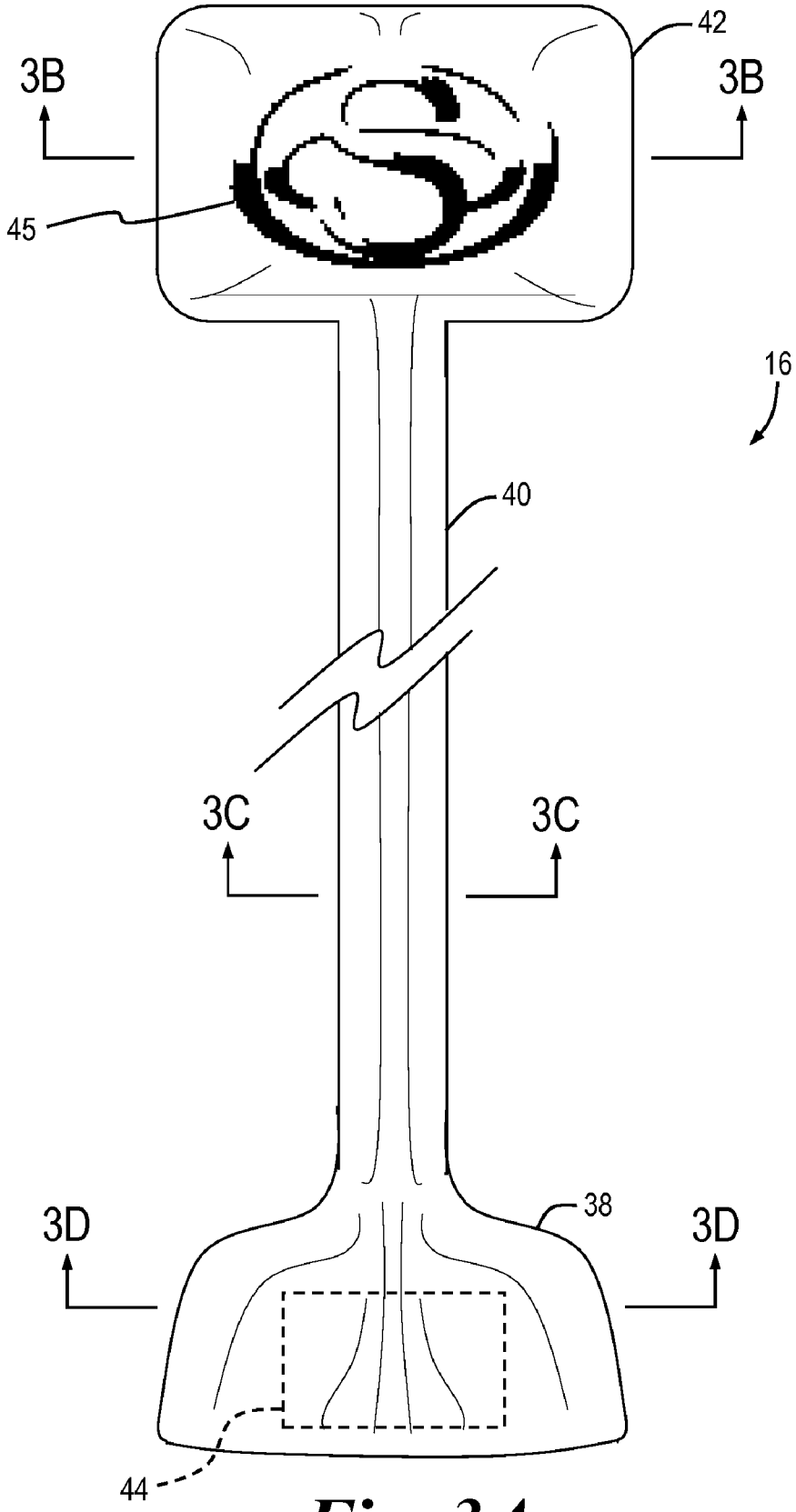
FIG. 3A is a front elevational view of a vertical member of the squat training device of FIG. 1.
Figure 4:
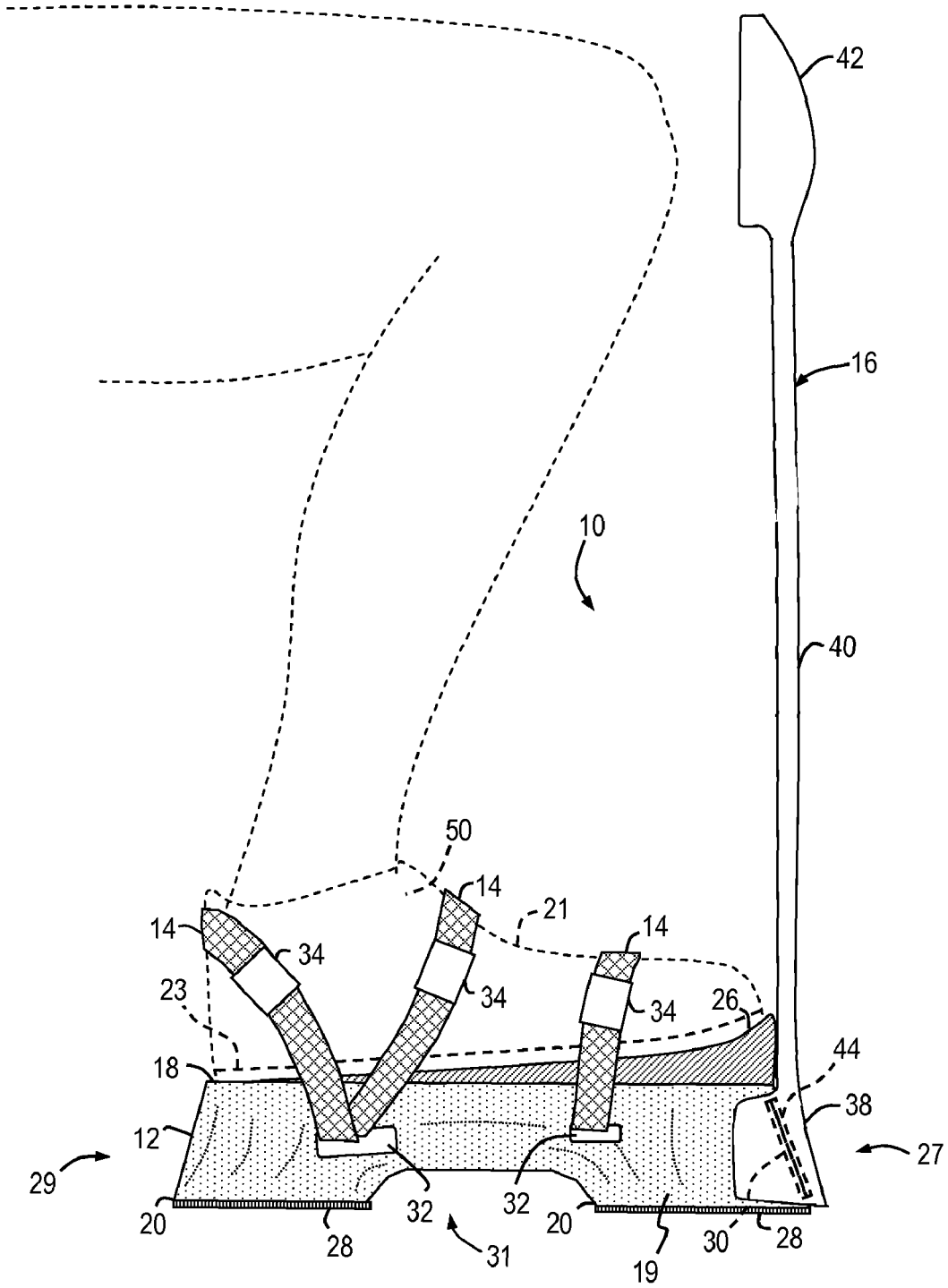
FIG. 4 is a side elevational view of the squat training device of FIG. 1.

Referring now to FIG. 3A, vertical member 16 comprises an attachment portion 38, a shaft 40 and a knee shield 42. Vertical member 16 is of sufficient length to extend from base 12 upwardly to the height of a user's knee, typically about 19 to about 23 inches high, as generally shown in FIG. 4. Vertical member 16 may be provided in varying sizes to accommodate the varying sizes of users of squat training device 10. Vertical member 16 is preferably sufficiently robust to resist bending or flexing under its own weight when connected to base 12 and to stand substantially upright without separate support.

Figure 3B:
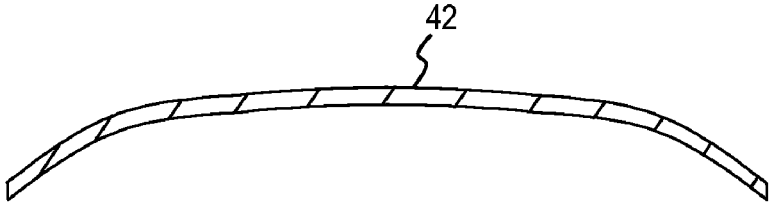
FIG. 3B is a cross sectional view of a knee shield portion of the vertical member of FIG. 3A.
Figure 3C:
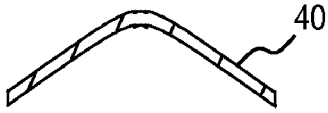
FIG. 3C is a cross sectional view of a shaft portion of the vertical member of FIG. 3A.
Figure 3D:
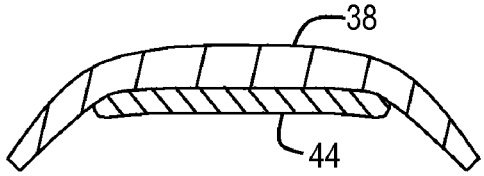
FIG. 3D is a cross sectional view of an attachment portion of the vertical member of FIG. 3A.

Attachment portion 38 comprises the bottom portion of vertical member 16 and includes a second connector 44 (FIGS. 3A, 3D) corresponding to first connector 30 of base 12 to allow the two components to be connected. Attachment portion 38 is formed to follow the contours of the toe end 27 of base 12 and to accommodate second connector 44, as depicted by the FIG. 3D. Attachment portion 38 may have any desirable dimensions and has a generally cupped shape to conform to base 12 and to provide structural support for shaft 40 and knee shield 42.

Second connector 44 generally comprises a fixture designed to mate with, and removably connect to first connector 30. Second connector 44 may be any type of fixture that is compatible with first connector 30 and providing similar properties including hook-and-loop fasteners, magnets and/or materials configured to attract and engage a magnet (including ferrous materials), clips or tabs, among others. Together, first connector 30 and second connector 44 form a breakaway connecting means for detachably coupling vertical member 16 to base 12.

Shaft 40 extends between attachment portion 38 and knee shield 42 as shown in FIG. 3A. Shaft 40 may have any suitable shape and cross-section so long as the shaft has sufficient strength to support knee shield 42 and has sufficient resistance to bending during use of squat training device 10. In some embodiments of the present invention shaft 40 has a V-shaped cross section of tapered width as compared to attachment portion 38 and knee shield 42 to provide reduced weight while also providing sufficient structural strength (see FIG. 3C).

Knee shield 42 is located at the top portion of vertical member 16 and at the end of shaft 40, as shown in FIG. 3A. Knee shield 42 extends from the top end of shaft 40 and expands to form an enlarged, generally vertically oriented, planar surface transverse to the longitudinal axis of base 12. Knee shield 42 may be contoured or cupped to generally conform to the shape of a user's knee (FIG. 3B) or may have any other desired shape. For example, knee shield 42 may have a generally cupped or pyramidal rectangular shape. In another embodiment of the present invention knee shield 42 may be omitted and shaft 40 extended sufficiently upwardly to perform the functions of the knee shield. Further, knee shield 42 may include a logo, trademark or other design 45 printed or molded along one or more of its surfaces, as depicted in FIG. 3A.

Vertical member 16 may be constructed from any suitable material such as, but not limited to plastic, wood, or metal among others. In one embodiment of the present invention vertical member 16 may be constructed from a plastic material which provides sufficient rigidity to allow the vertical member to function properly, while providing sufficient flexibility to resist breaking and to reduce the risk of injury to a user who may fall on or strike the member.

With reference to FIGS. 1 and 2, in one embodiment of the present invention squat training device 10 may be produced by placing traction features 22 along top portion 18 as well as a size indicator 24 upon the top portion. Rim 26 is attached to base 12 such that the rim has a maximum height near the toe end 27 of base 12 and then decreases in height as it extends toward the heel end 29 of the base. One or more rubber treads 28 pieces are joined to bottom 20 with adhesive. Straps 14 are inserted through apertures 32 and their associated buckle or clasps utilized to attach the ends together such that the straps will retain an athletic shoe placed upon top portion 18 of base 12. Vertical member 16 is attached along the toe end 27 of base 12 by coupling together first and second connectors 30, 44 respectively.

Referring now to FIG. 4 in addition to FIGS. 1, 2 and 3A-D, squat training device 10 is used by first selecting the correctly sized base 12 for a given user. Sizes are selected based on the athletic shoe 21 size worn by the user, or may be universal depending on a chosen design of squat training device 10. If available, the proper size of vertical member 16 is also selected, but a standard length for all users may also be provided. In use, squat training device 10 is utilized as a pair of devices wherein one device is attached to each foot of a user weight lifter. The user inserts a shoed foot into straps 14 of each of a pair of squat training devices 10 and locates the toe of their athletic shoe 21 against rim 26. It should be noted that the user is preferably wearing athletic shoes 21 on their feet prior to inserting their feet into straps 14. The user tightens straps 14 sufficiently to retain the user's heel against top portion 18 during the exercise. A vertical member 16 is attached to the toe end 27 of each base 14 by coupling first connector 30 to second connector 44 such that the vertical members extend upwardly from the bases 12 to approximately the level of the user's knees. The user then places their feet with squat training devices 10 attached thereto in the conventional proper position for the squat exercise, obtains their weights or resistance and initiates the exercise. The design of the present invention also allows a user to walk around to a limited extent to allow the user to obtain a desired weight or resistance element and to move to a desired exercise area.

During the exercise, as the user moves downward into the squatting position their knees should remain directly behind, but not touching knee shields 42 as depicted in FIG. 4. Straps 14 should be tight enough to retain the user's heels in contact with top portion 18. This foot and heel position should be maintained as the user completes the exercise to retain proper form. As the user completes the exercise they may visually watch the position of their knees and receive visual cues on the correctness of their form based on the position of their knees with respect to knee shields 42. With correct form, the user's knees will remain directly behind knee shields 42 without touching the knee shields. The user may also receive tactile cues that their form is not correct if their knees move forward over their toes and contact knee shields 42. This allows the user to fix their positioning and return to proper form. In addition, where hook-and-loop or other similar break-away connectors 30, 44 having an audibly perceptible disconnection characteristic is selected the user is provided with an aural cue when their knees move forward over their toes and push knee shields 42 forwardly, causing a partial or complete detachment of vertical member 16 from base 12, as shown in FIG. 5. Upon completing the exercise the user removes squat training devices 10 by loosening straps 14 and removing their feet. Vertical members 16 may be left in place or disconnected by pulling them away from base 12. Once disconnected, vertical members 16 and bases 12 are easily stored and/or transported in a locker, gym bag, box or other container.

Figure 6:
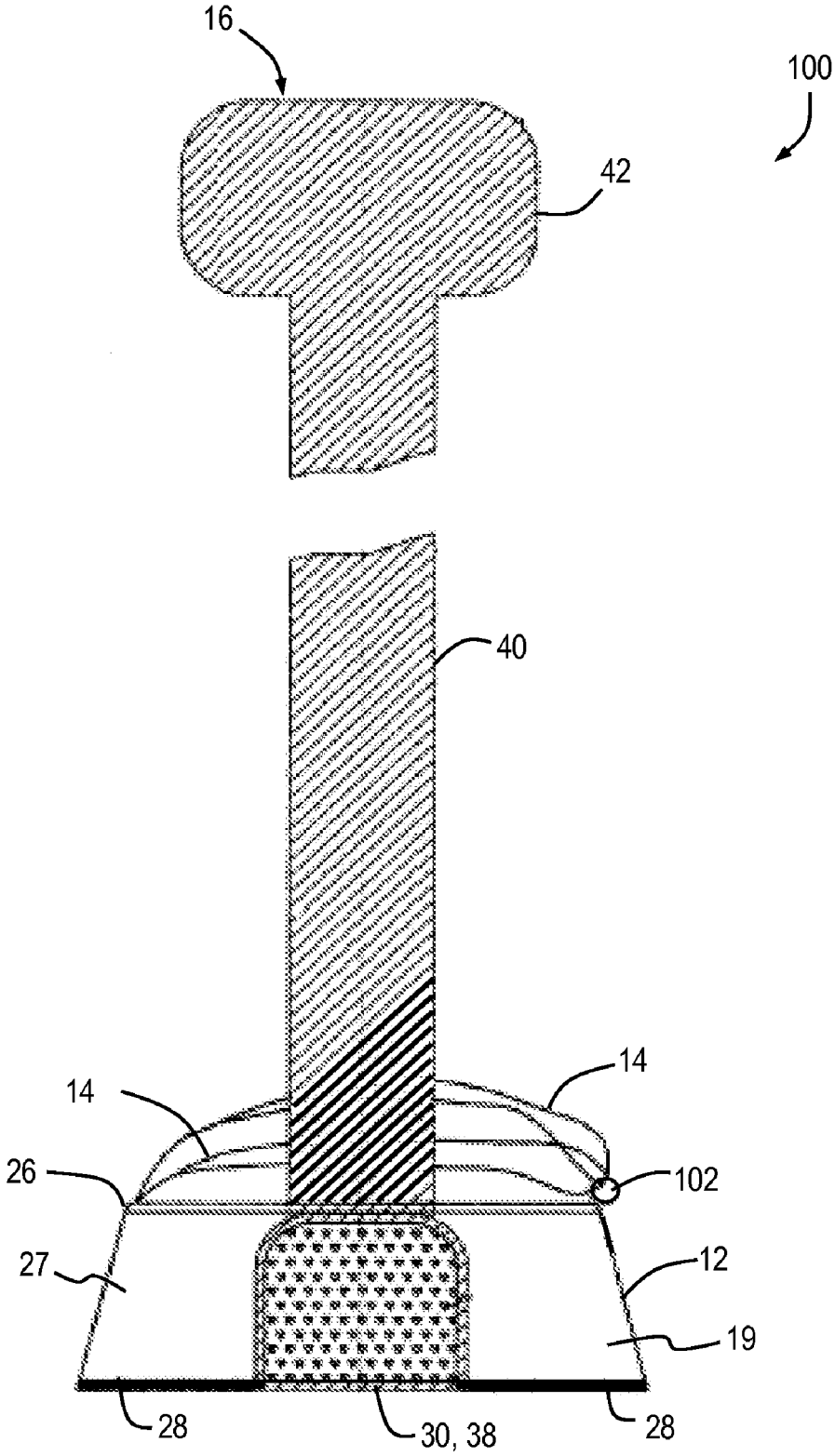
FIG. 6 is an elevational view of a toe end of a squat training device according to an alternate embodiment of the present invention.
Figure 7:
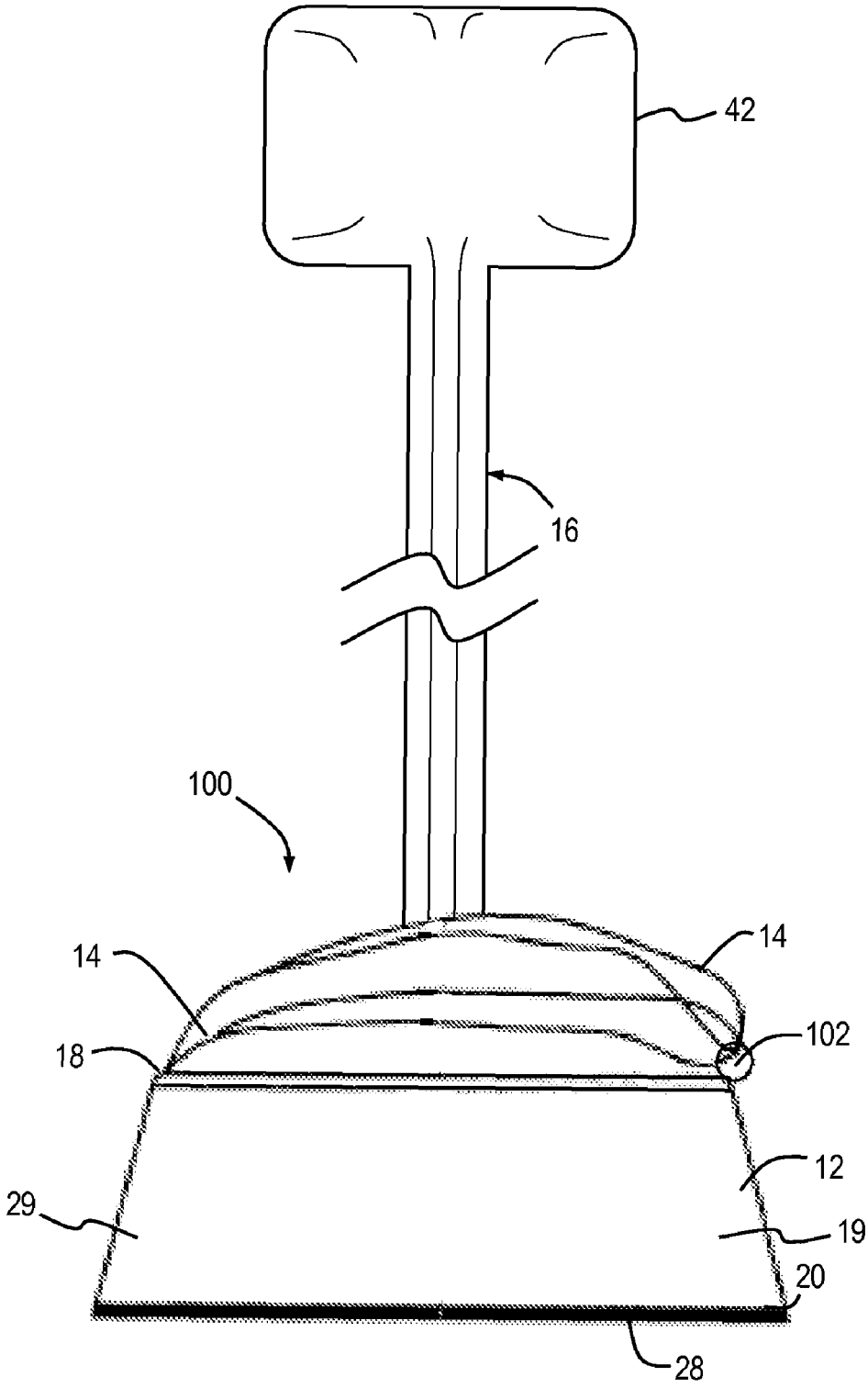
FIG. 7 is an elevational view of a heel end of the squat training device of FIG. 6.
Figure 8:
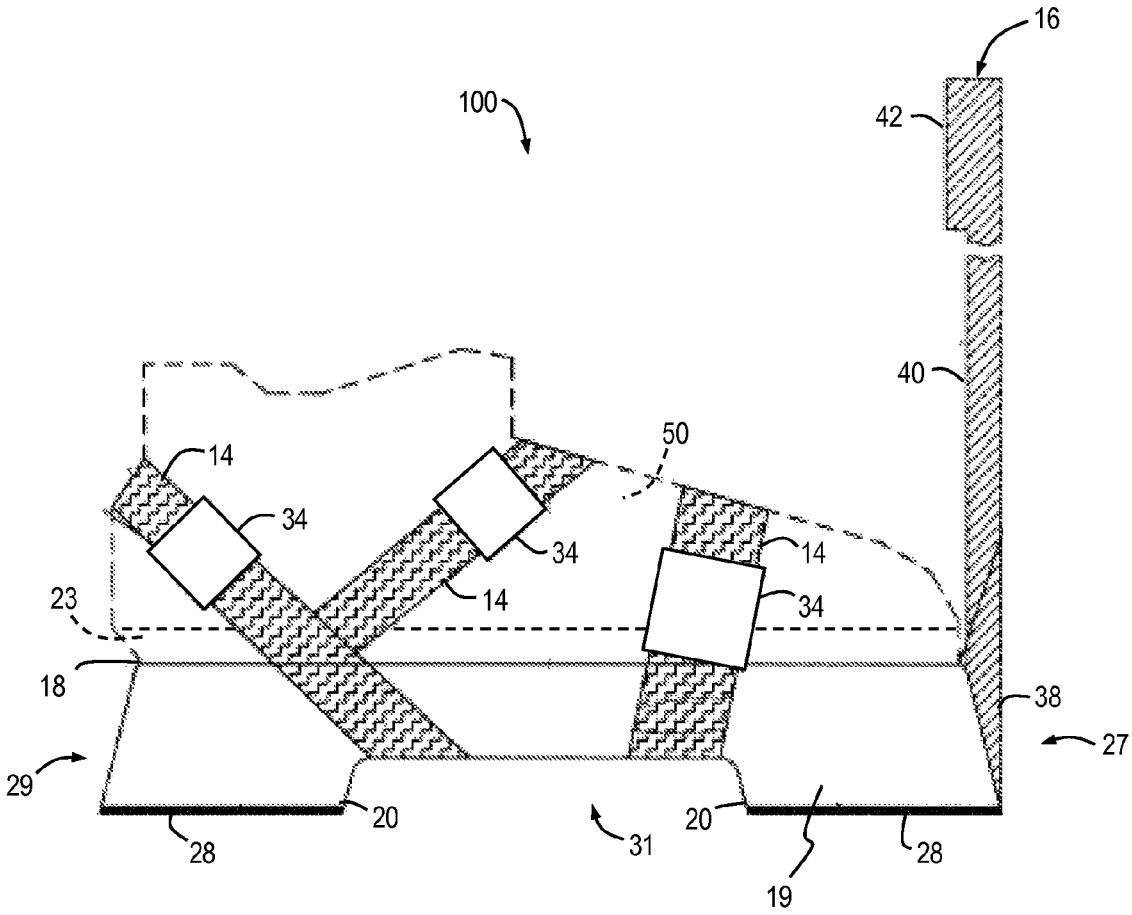
FIG. 8 is a side elevational view of the squat training device of FIG. 6 depicting an alternate embodiment of the attachment of straps to the base.

Referring now to FIGS. 6-8, a squat training device 100 is disclosed according to another embodiment of the present invention. As shown in FIGS. 6 and 7 a plurality of buckles 102 are attached along base 12 near, or on, top portion 18. As shown by FIG. 8 a first end of straps 14 may be fixedly attached along one side of base 12 opposite from buckles 102 such that the strap may extend over top portion 18 of the base, insert through a buckle, fold back onto itself and attach thereto with hook-and-loop, clasps or buckles, among other features.

As shown in FIG. 5, in some embodiments of the present invention shaft 40 may comprise a pair of overlapping, adjustable-length shafts 104A, 104B, each having a slot or series of generally aligned apertures through which a fastener 106 is inserted to secure the shafts together.

Figure 9:
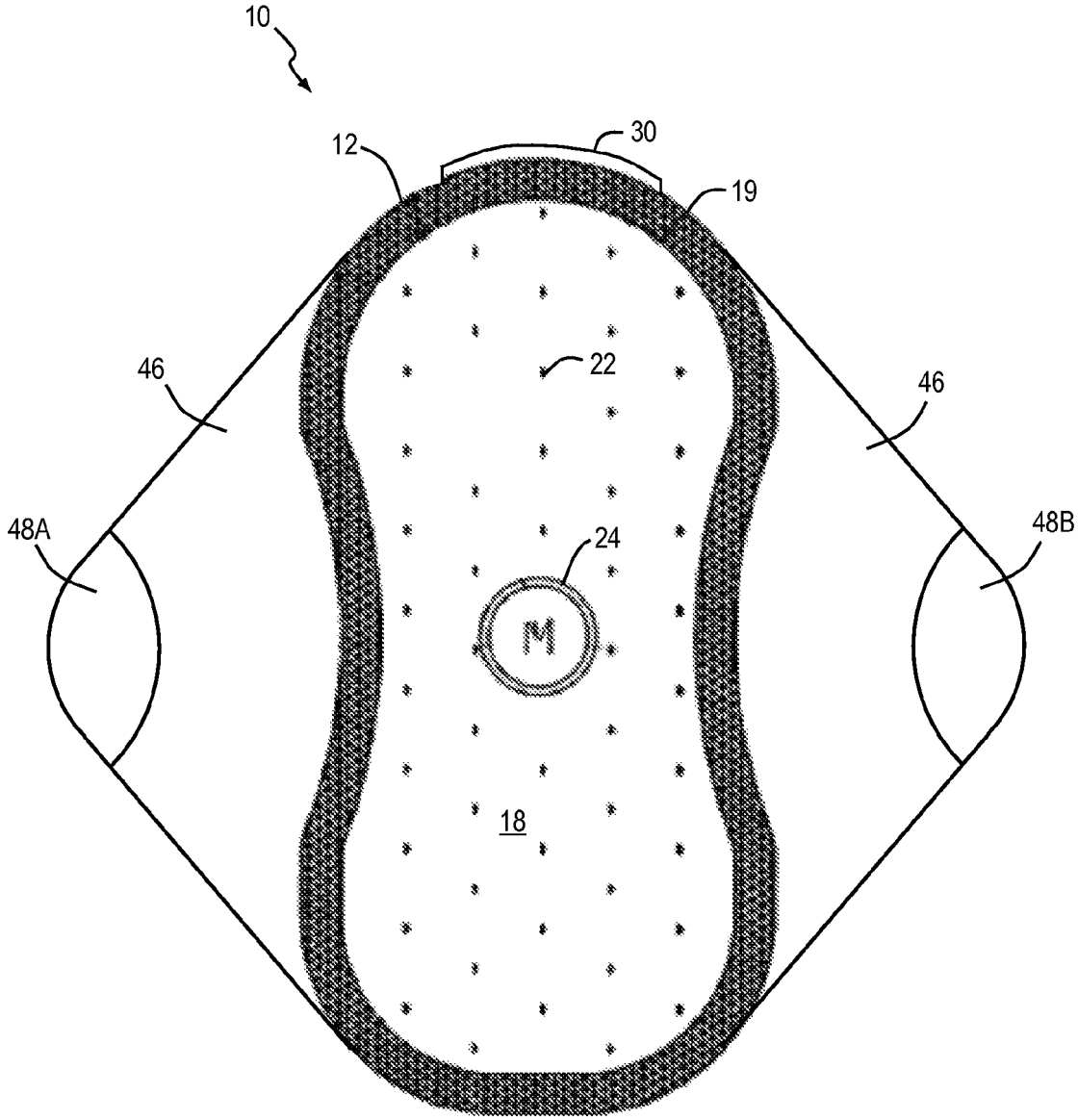
FIG. 9 is a top plan view of a base having a pair of flaps, according to another alternate embodiment of the present invention.

Another alternate embodiment of the present invention is shown in FIG. 9, wherein straps 14 (see, e.g., FIG. 1) of base 12 are replaced with a pair of generally flexible flaps 46 attached to the base. One flap 46 has a first connector portion 48A, configured to detachably engage a complementary second connector portion 48B of a second flap. Flaps 46 may be made from any flexible material compatible with squat training devices 10, 100. Example materials include, without limitation, cloth and nylon. Connectors 48A, 48B may be any conventional type of detachable connector elements suitable for securing base 12 to a user's shoed foot 21 (FIG. 1) such as, without limitation, hook-and-loop fasteners. In use, a user places a shoed foot upon top portion 18 of base 12 and wraps flaps 46 over an upper 50 of shoe 21 (FIG. 1), overlapping the flaps and coupling together connectors 48A, 48B to substantially rigidly secure the base to the shoes. In some embodiments flaps 46 are shaped such that a user's toes are uncovered when flaps 46 are secured together by connectors 48A, 48B and base 12 is secured to a user's shoe 21, thereby providing the user with a visual cue with regard to his/her toes when determining the proper squat exercise form. This embodiment of the present invention is otherwise substantially similar to squat training devices 10, 100 described above, and thus will not be reiterated further here.

While this invention has been shown and described with respect to a detailed embodiment thereof, it will be understood by those skilled in the art that changes in form and detail thereof may be made without departing from the scope of the claims of the invention.

What is claimed is:

1. A squat training device, comprising:

a generally planar base having a generally vertically-oriented sidewall, the base being shaped to receive a foot of a user;

a plurality of straps coupled to the base and configured to secure the foot to the base;

a vertical member having a first end and a second, opposing end; and a breakaway connecting means disposed directly between the sidewall of the base and the first end of the vertical member, the first end of the vertical member being detachably coupled to the sidewall of the base by the breakaway connecting means, the vertical member extending upwardly from the base, the vertical member being detachable from the base at the breakaway connecting means when the vertical member is urged away from the base by a knee of the user that is one the same leg as the foot.

2. The squat training device of claim 1 wherein the breakaway connecting means comprises at least one of hook-and-loop fasteners, clips, tabs, magnets and fasteners, and wherein a portion of the breakaway connecting means remains attached to the sidewall of the base when the vertical member is urged away from the base.

3. The squat training device of claim 1 wherein the vertical member further includes a knee shield.

4. The squat training device of claim 3 wherein the knee shield further includes at least one of a size indicator, logo, trademark or design.

5. The squat training device of claim 3 wherein the knee shield is generally contoured.

6. The squat training device of claim 1 wherein the straps extend through apertures formed generally transverse to a longitudinal axis of the base.

7. The squat training device of claim 1 wherein a top portion of the base includes traction features.

8. The squat training device of claim 1 wherein a top portion of the base includes a rim about a perimeter thereof.

9. The squat training device of claim 1 wherein a bottom portion of the base includes a tread.

10. The squat training device of claim 1 wherein a bottom portion of the base includes a cut-away section.

11. The squat training device of claim 1 wherein the vertical member provides a user with at least one of visual, tactile and aural indication of exercise form.

12. The squat training device of claim 1 wherein the vertical member includes an attachment portion generally conforming to the base.

13. The squat training device of claim 1 wherein the vertical member is adjustable in length.

14. The squat training device of claim 1 wherein the straps are coupled to at least one buckle joined to the base.

15. A squat training device, comprising:

a generally planar base having a generally vertically-oriented sidewall, the base being shaped to receive a foot of a user;

a plurality of straps coupled to the base with hook-and-loop fasteners and configured to secure the foot to the base;

a vertical member having a first end and a second, opposing end, the second end further including a knee shield; and a breakaway connecting means disposed directly between a surface of the sidewall of the base and a surface of the first end of the vertical member, the first end of the vertical member being detachably coupled to the sidewall of the base by the breakaway connecting means, the vertical member extending upwardly from the base, the vertical member being detachable from the base at the breakaway connecting means when the vertical member is urged away from the base by a knee of the user that is one the same leg as the foot.

16. The squat training device of claim 15 wherein a top portion of the base includes traction features.

17. The squat training device of claim 15 wherein a top portion of the base includes a rim about a perimeter thereof.

18. The squat training device of claim 15 wherein a bottom portion of the base includes a tread.

19. The squat training device of claim 15 wherein the vertical member provides a user with at least one of visual, tactile and aural indication of exercise form.

* * * * *